US007263753B2

(12) United States Patent
El Dessouky

(10) Patent No.: US 7,263,753 B2
(45) Date of Patent: Sep. 4, 2007

(54) BLIND BOLT INSTALLATION TOOL

(75) Inventor: Ahmed A. El Dessouky, Anaheim Hills, CA (US)

(73) Assignee: SPS Technologies, LLC, Jenkintown, PA (US)

( * ) Notice: Subject to any disclaimer, the term of this patent is extended or adjusted under 35 U.S.C. 154(b) by 171 days.

(21) Appl. No.: 11/146,588

(22) Filed: Jun. 7, 2005

(65) Prior Publication Data

US 2005/0278918 A1 Dec. 22, 2005

Related U.S. Application Data

(60) Provisional application No. 60/582,210, filed on Jun. 22, 2004.

(51) Int. Cl.
*B21J 15/10* (2006.01)
*B21D 31/00* (2006.01)

(52) U.S. Cl. ..... 29/243.521; 29/243.523; 72/391.4

(58) Field of Classification Search ..... 29/243.521, 29/243.523, 243.526, 243.527; 72/391.2, 72/391.4, 391.6
See application file for complete search history.

(56) References Cited

U.S. PATENT DOCUMENTS 3,100,578 A * 8/1963 Halverson et al. ..... 29/243.521
3,324,700 A 6/1967 Elliot
3,363,445 A * 1/1968 Sanders et al. ..... 29/243.521
3,406,557 A 10/1968 Harris
3,646,800 A 3/1972 Martin
3,760,627 A * 9/1973 Richardson et al. ... 29/243.523
4,432,679 A 2/1984 Angelosanto et al.
4,520,648 A * 6/1985 Gregory ..... 29/243.527
4,653,308 A * 3/1987 Gregory ..... 29/243.527
4,844,673 A 7/1989 Kendall
5,219,375 A * 6/1993 Kamata et al. ..... 29/243.526
5,357,666 A * 10/1994 El Dessouky et al. .. 29/243.521
5,802,691 A * 9/1998 Zoltaszek ..... 29/243.526
6,018,978 A * 2/2000 Aniento ..... 72/391.4

FOREIGN PATENT DOCUMENTS

GB 949708 2/1964

* cited by examiner

*Primary Examiner*—David B Jones
(74) *Attorney, Agent, or Firm*—Trexler, Bushnell, Giangiorgi, Blackstone & Marr, Ltd.

(57) ABSTRACT

A pulling head includes a sleeve which threadably engages a sleeve adapter. A collet is threadably engaged with a drawbar adapter, and the collet and drawbar adapter are disposed and slidable in the sleeve. A set of jaws is disposed in the collet, and a jaw follower is disposed in the collet and contacts the jaws. A spring retainer is disposed in the collet, and engages two springs. Specifically, a first spring is disposed between the drawbar adapter and the spring retainer, and a second spring is disposed between the spring retainer and the jaw follower. The first spring has a higher rating than does the second spring. While the first spring is configured to accommodate inertia loading, the second spring is configured to urge the jaws closed yet be relatively easily overcome by the insertion of mandrels of different diameters.

7 Claims, 11 Drawing Sheets

BLIND BOLT INSTALLATION TOOL

RELATED APPLICATION (PRIORITY CLAIM)

This application claims the benefit of U.S. Provisional Application Ser. No. 60/582,210, filed Jun. 22, 2004.

BACKGROUND

This invention generally relates to tools for installing blind bolts, and more specifically relates to a blind bolt installation tool which includes springs having different ratings to overcome certain problems experienced in the prior art as discussed hereinafter.

FIGS. 1-10 illustrate two different pulling heads 10*a* (FIGS. 1-5) and 10*b* (FIGS. 6-10) for installing blind bolts such as that which is shown in the drawings (see also U.S. Pat. Nos. 4,432,679 and 4,844,673 which are hereby incorporated herein by reference in their entirety). As shown, the pulling heads 10*a*, 10*b* may be configured to work with blind bolts which include a mandrel 28*a*, 28*b*, a shift washer 62 and a sleeve 63, wherein the mandrel is pulled to install the fastener 12*a*, 12*b*, and the mandrel 28*a*, 28*b* breaks off during installation.

In general, concerning the disposition of jaws before a fastener is inserted, pulling heads can be classified into two categories: "open jaw" and "closed jaw" designs. In both designs, a set of jaws grip the mandrel of the fastener. In an open jaw design, the jaws are normally open, and must be closed onto the mandrel. In contrast, in a closed jaw design, the jaws are normally too close together to insert a mandrel between them. Therefore, the jaws must be opened in order to insert the mandrel.

FIG. 1 illustrates a pulling head 10*a* having a closed jaw design, while FIG. 6 illustrates a pulling head having 10*b* an open jaw design. Each pulling head is configured to be threadably engaged with an installation tool, which for clarity, is omitted from the drawings. When an installation tool is engaged with the pulling head 10*a* or 10*b*, and the installation tool is actuated, the installation tool operates the pulling head to install a fastener.

As shown in FIG. 1, the closed jaw pulling head 10*a* includes a set of jaws 14*a* (a typical set having two or three jaws) about the longitudinal axis 16 of the pulling head. Each jaw 14*a* of the set includes an angled or conical portion 18 on an outer surface 20 and a serrated portion 22 on an inner surface 24, where the serrated portion 22 is configured to grippingly engage corresponding serrations 26 provided on the mandrel 28 of a fastener or blind bolt 12*a*.

The jaws 14*a* are disposed in a taper 30 provided in a collet 32*a*. When the jaws 14*a* are in the forward-most position as illustrated in FIG. 1, the internal diameter 34 defined by the jaws 14*a* is generally smaller than the diameter 36 of the mandrel 28*a* of the fastener 12*a* to be inserted in the jaws 14*a*. The fastener 12*a* is a conventional blind bolt design, generally as shown in the abovementioned U.S. Pat. Nos. 4,432,679 and 4,844,673 and numerous other prior art patents. Hence, the jaws 14*a* are said to be "closed." A threaded portion 38 is provided in the collet 32*a* for engagement with a head piston of the installation tool. The collet 32*a* is generally cylindrical and includes a main internal bore 40. The jaws 14*a*, a jaw follower 42*a*, and a follower spring 44*a* are disposed in the collet 32*a*. The jaw follower 42*a* holds the jaws 14*a* generally in position. The jaw follower 42*a* is also generally cylindrical and includes a longitudinal throughbore 46 which is configured to receive a broken stem or mandrel 28*a* of the blind bolt or fastener 12*a*.

The jaw follower 42*a* is subject to a spring load viz-a-viz the follower spring 44*a*. One end 48 of the follower spring 44*a* contacts a shoulder 50 on an outer surface 52 of the jaw follower 42*a*, while the other end 52 of the follower spring 44 contacts the installation tool when the installation tool is engaged with the pulling head 10*a*. The follower spring 44*a* effectively acts as a shock absorber when the mandrel 28*a* of the fastener 12*a* breaks during installation, keeping the jaw follower 42*a* from accelerating rapidly backwards and impacting other components. The collet 32*a* is disposed in a sleeve 54*a*, and is moveable relative thereto. A threaded aperture 56 is provided at an end 58 of the sleeve 54*a*, and a nosepiece 60*a* is threadably engaged in the threaded aperture 56.

In operation, as the mandrel 28*a* of a fastener 12*a* is inserted into the nosepiece 60*a* as shown in FIG. 2, the mandrel 28*a* opens the jaws 14*a* against the spring load (provided by spring 44*a*). The mandrel 28*a* is pushed into the nosepiece 60*a* until a shift washer 62 of the fastener 12*a* bottoms on or contacts the nosepiece 60*a* as shown in FIG. 3. Because the jaws 14*a* sit in a taper 30, the jaws 14*a* have to move back as they expand, until their serrations 22 are aligned with the serrations 26 of the mandrel 28*a*. As the jaws 14*a* open, the serrations 26 on the mandrel 28*a* rub against the serrations 22 of the jaws 14*a*, causing wear. To minimize operator effect, and the possibility of fastener disassembly between the sleeve 54*a* and the mandrel 28*a*, the follower spring 44*a* is preferably configured to have a relatively small spring rate.

As shown in FIG. 4, when the tool is actuated (i.e., the trigger of the tool is depressed), the collet 32*a*, which is threadably attached to the head piston of the installation tool, moves back under load. The travel of the head piston (not shown) is known as the "stroke" of the tool, said "stroke" being identified with arrow 62 in FIG. 4. The taper 30 of the collet 32*a* transfers the pulling force of the tool to the jaws 14*a*, which grip the mandrel 28*a*. The fastener 12*a* is installed as the mandrel 28*a* moves relative to the sleeve 63 of fastener 12*a*, to deform the sleeve 63 and set the locking collar as is conventional in the art, and as shown in the previously-mentioned patents. The pulling force continues until the mandrel 28*a* fractures or breaks at the break notch, thus completing the installation. Because the follower spring 44*a* must also act as a shock absorber, the break load of the fastener must be relatively small, so that the spring 44*a* can absorb the kinetic energy of the installation without taking too much of a permanent "set." When the mandrel 28*a* breaks off, the mandrel 28*a* is still held by the jaws 14*a*.

When the installation tool's trigger is released, the head piston and collet 32*a* return to their home position as shown in FIG. 5. As shown, the broken mandrel 28*a* is still held in the jaws 14*a* under a spring load. When the next fastener is inserted, its mandrel will push the broken mandrel of the previously installed fastener through the jaws 14*a*, causing more wear.

FIG. 6 illustrates an open jaw pulling head 10*b*. The design is similar to the closed jaw pulling head in that the design includes a sleeve 54*b*, a collet 32*b*, jaws 14*b*, a jaw follower 42*b*, a follower spring 44*b*, and a nosepiece 60*b*. However, in an open jaw design, the jaws 14*b* are forced open when in their forward-most or home position such that the inner shape formed by the jaws 14*b* is larger than the diameter of the fastener to be inserted. This is usually accomplished by a rear protrusion 64 of the nosepiece 60*b*, which protrudes into the collet 32*b*, being configured to open the jaws 14*b* when the pulling head is in its "home" position. Therefore, the jaws 14*b* are open before the mandrel or stem 28*b* of the fastener 12*b* is inserted, allowing the mandrel 28*b* to be inserted with no resistance, and also removed, if necessary.

FIG. 7 illustrates a mandrel 28*b* placed in the pulling head 10*b*. There is no resistance involved in placing the mandrel 28*b* in this position because the inner diameter 70 of each of the jaws 14*b* is larger than the diameter of the mandrel 28*b*, so the fastener 12*b* could also be inserted and retained by a vacuum force. At this point, the jaws 14*b* are forced open by the rear protruding portion 64 of the nosepiece 60*b*. The jaws 14*b* are forced back by this protrusion 64 and, therefore, are forced open and outward against the taper 72 of the collet 32*b* by the spring load. At this point, the fastener 12*b* could be removed from the pulling head 10*b*, because the jaws 14*b* are not gripping the mandrel 28*b*.

When the rivet tool is activated, the collet 32*b* begins moving back, away from the nosepiece 60*b*, as shown in FIG. 8. The jaws 14*b* begin to close in the taper 72 of the collet 32*b* as the protrusion 64 of the nosepiece 60*b* into the collet 32*b* diminishes. As the collet 32*b* pulls away from the rear protrusion 64 of the nosepiece 60*b*, the jaw set is pushed forward by the spring load and closes on the stem 28*b*. The smaller the stem 28*b*, the more stroke it takes for the jaws 14*b* to make contact. Subsequently, the mandrel 28*b* is pulled until the fastener 12*b* is installed.

As illustrated in FIG. 9, the mandrel 28*b* breaks and the collet 32*b* travels to its extreme position as the tool completes its stroke. More stroke is required to install a fastener using an open jaw pulling head design than is required by a closed jaw design. After the mandrel 28*b* breaks, the mandrel 28*b* is still held by the jaws 14*b*.

As shown in FIG. 10, as the collet 32*b* returns to its "home" position at the end of the tool cycle, the nosepiece 60*b* again contacts and opens the jaws 14*b*, allowing the mandrel 28*b* to be released. The broken stem 28*b* is free to move under the force of gravity, or to be extracted by a vacuum force. In either case, the jaws 14*b* experience no wear from the extraction or by the insertion of the next fastener.

Because the mandrel 28*b* does not have to force open the jaws 14*b* upon insertion (see FIG. 7), the follower spring 44*b* can be stronger than in the closed jaw design. This spring 44*b* could absorb more kinetic energy, so the break load of the fastener used could also be higher than in the closed jaw design. However, the mandrel 28*b* of a fastener used in the open jaw design must be long enough to extend beyond the longer nosepiece 60*b*, far enough so that the jaws 14*b* can grip it. Also, the stroke of the tool that is used while the jaws 14*b* close on the mandrel 28*b* is wasted.

Typically, closed jaw designs such as that which is shown in FIGS. 1-5 are used to install low-break load fasteners. Closed jaw designs typically employ an internal spring (i.e., part number 44*a* as discussed above and identified in FIGS. 1-5) which has a relatively low spring rate. The arrangement makes the installation of different size diameters with relatively short stem fasteners possible. In contrast, open jaw designs such as that which is shown in FIGS. 6-10 are typically used to install a single size diameter of high-break load fastener. Open jaw designs typically employ an internal spring (i.e., part number 44*b* as discussed above and identified in FIGS. 1-5) which has a relatively high spring rate. The arrangement makes the installation of different size diameters very difficult, and makes the installation of fasteners with very short stems impossible.

OBJECTS AND SUMMARY

An object of an embodiment of the present invention is provide a pulling head which can be used in association with a wide range of mandrel diameters.

Another object of an embodiment of the present invention is provide a pulling head which can accommodate high inertia loading as well as accommodate fasteners that have extra-short stems.

Briefly, and in accordance with at least one of the foregoing objects, an embodiment of the present invention provides a pulling head which includes two springs having different spring rates—a first, higher rated spring so that the pulling head can accommodate high inertia loading; and a second, lower rated spring so that the pulling head can be used in association with a wide range of mandrel diameters.

A specific embodiment of the present invention provides a pulling head which is configured for engagement with an installation tool. The pulling head includes an external body which is engageable with the installation tool. The external body may include a sleeve which threadably engages a sleeve adapter and a jam nut which secures the sleeve relative to the sleeve adapter. A collet is threadably engaged with a drawbar adapter, and the collet and drawbar adapter are disposed and slidable in the sleeve. A set of jaws is disposed in the collet, proximate a taper provided in the collet. A jaw follower is also disposed in the collet and contactably engages the jaws. A spring retainer is disposed in the collet, and engages two springs. Specifically, a first spring is disposed between the drawbar adapter and the spring retainer, and a second spring is disposed between the spring retainer and the jaw follower. The first spring has a higher rating than does the second spring. While the first spring is configured to accommodate inertia loading, the second spring is configured to urge the jaws closed yet be relatively easily overcome by the insertion of mandrels of different diameters into an opening provided in the end of the sleeve.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION

Figure 1:
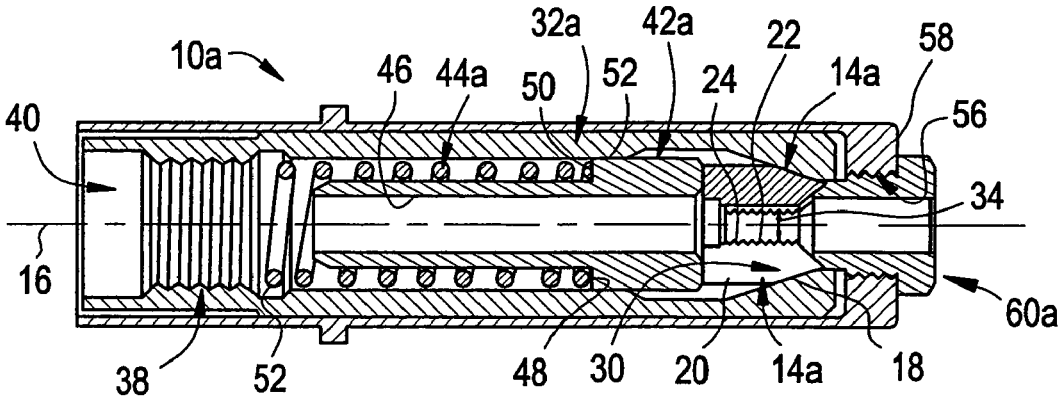
FIG. 1 is a cross-sectional view of a pulling head having a closed jaw design.
Figure 2:
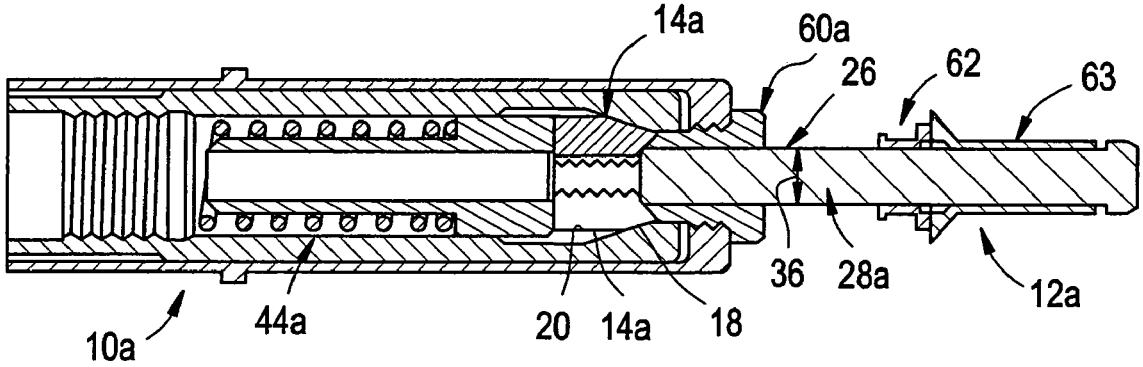
FIGS. 2-5 are views similar to FIG. 1, showing a sequence of operation of the closed jaw design.
Figure 3:
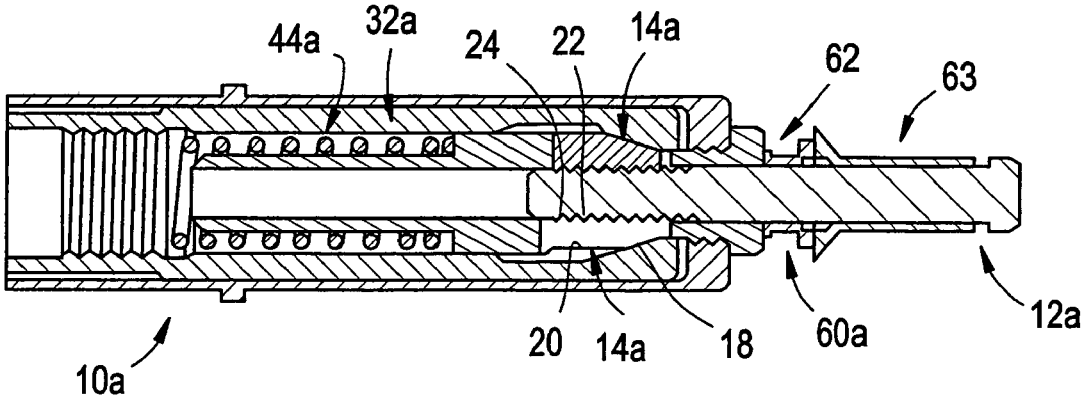
Figure 4:
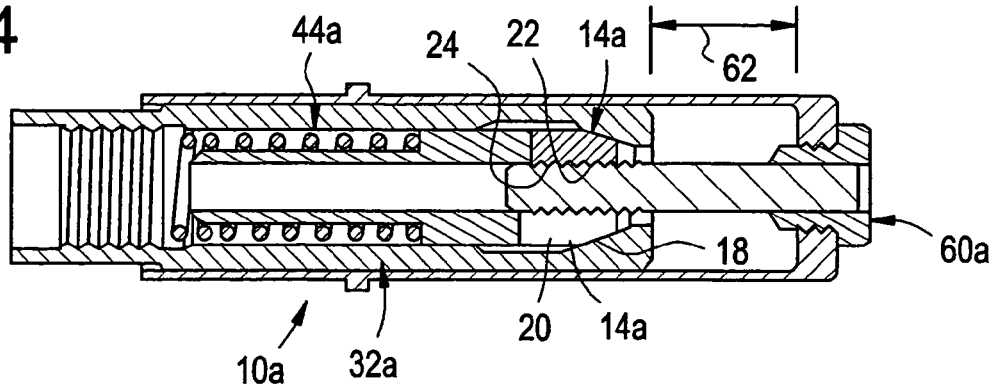
Figure 5:
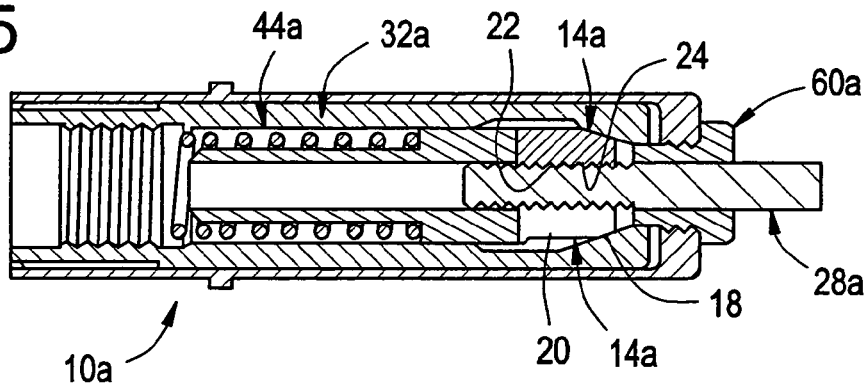
Figure 6:
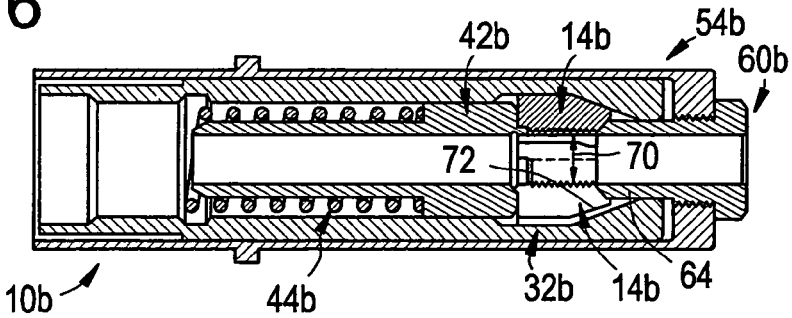
FIG. 6 is a cross-sectional view of a pulling head having an open jaw design.
Figure 7:
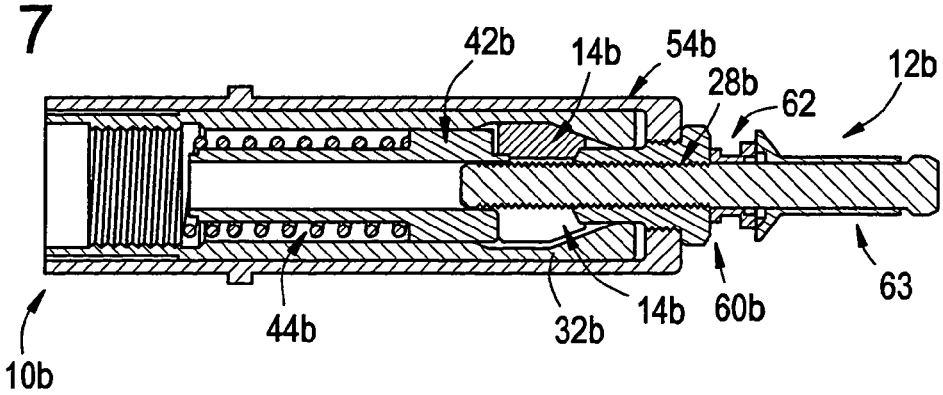
FIGS. 7-10 are views similar to FIG. 6, showing a sequence of operation of the open jaw design.
Figure 8:
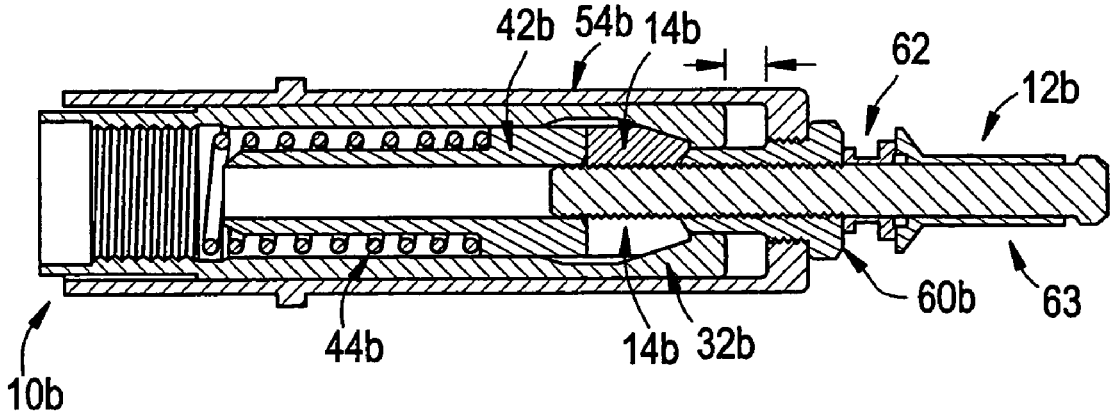
Figure 9:
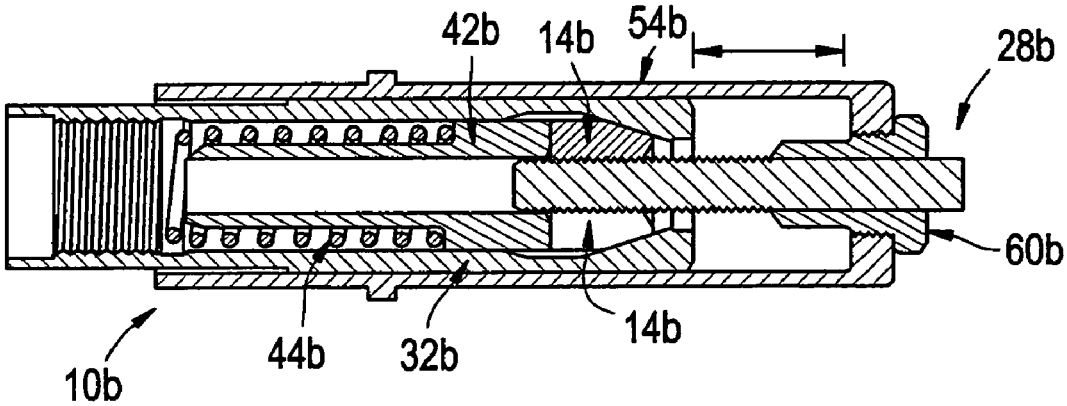
Figure 10:
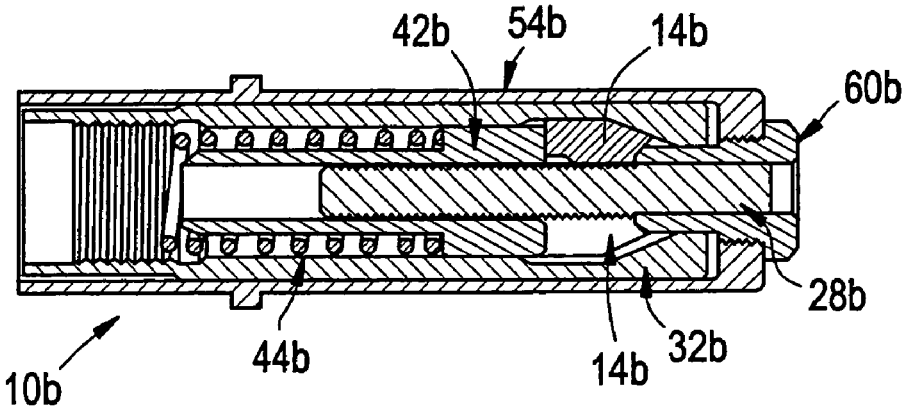

While the present invention may be susceptible to embodiment in different forms, there is shown in the drawings, and herein will be described in detail, an embodiment thereof with the understanding that the present description is to be considered an exemplification of the principles of the invention and is not intended to limit the invention to that as illustrated and described herein.

Figure 11:
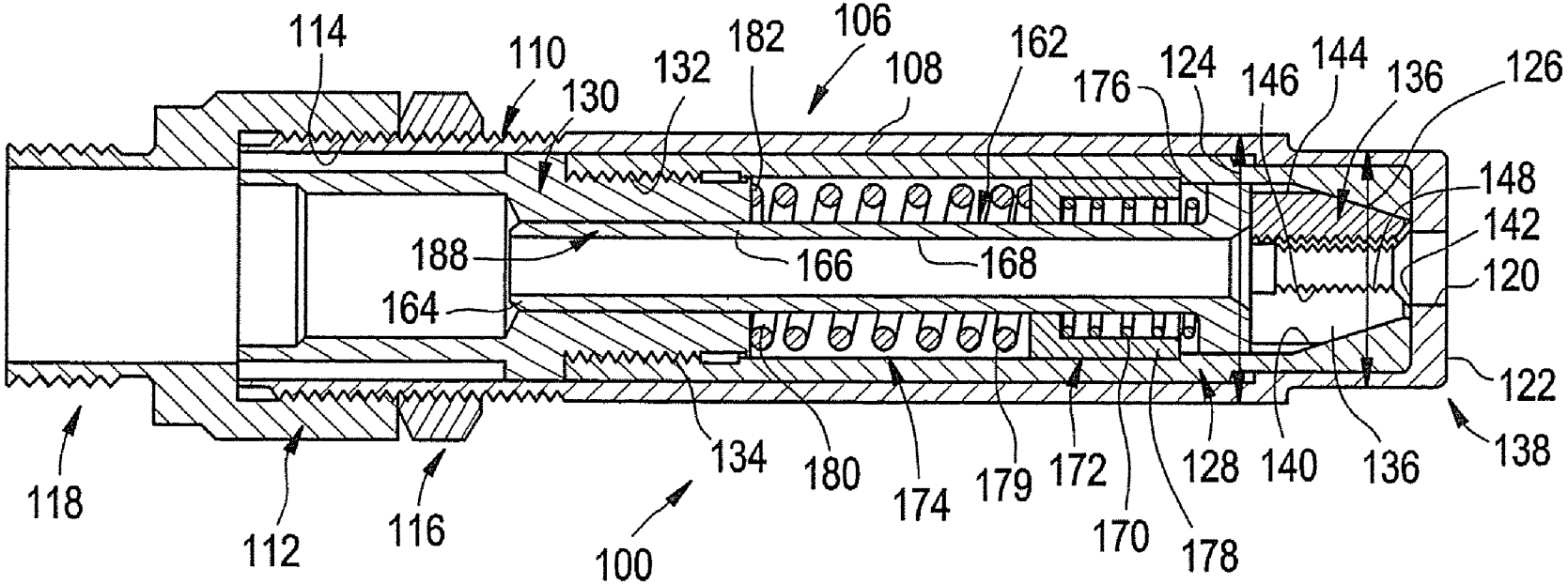
FIG. 11 is a cross-sectional view of a pulling head which is in accordance with an embodiment of the present invention.

FIG. 11 illustrates a pulling head 100 which is in accordance with an embodiment of the present invention. The pulling head 100 includes two springs having different spring rates—a first, higher rated spring 174 so that the pulling head 100 can accommodate high inertia loading; and a second, lower rated spring 170 so that the pulling head 100 can be used in association with a wide range of mandrel diameters.

The pulling head 100 is configured for engagement with an installation tool. Specifically, the pulling head 100 includes an external body 106 which is engageable with the installation tool. The external body 106 may consist of a sleeve 108 which includes an external threaded portion 110 and a sleeve adapter 112 which includes a corresponding internal threaded portion 114. The threaded portion 110 of the sleeve 108 threadably engages the threaded portion 114 of the sleeve adapter 112. A jam nut 116 is threadable onto the threaded portion 110 of the sleeve 108, and secures the sleeve 108 relative to the sleeve adapter 112. Specifically, during assembly, the jam nut 116 is threaded onto the sleeve 108, the sleeve 108 is threaded into the sleeve adapter 112, and the jam nut 116 is rotated into contact with the sleeve adapter 112. The sleeve 108, sleeve adapter 112 and jam nut 116 comprise a subassembly, which remains stationary during the installation process. The sleeve adapter 112 includes an additional external threaded portion 118, which is configured to be threaded directly into the head cylinder of an installation tool. Preferably, the pulling head 100 has no nosepiece, and includes only an opening 120 in the end 122 of the sleeve 108. The sleeve 108 preferably has two outer diameters 124 and 126, with the smaller diameter 126 being at the working end for the greatest possible access to confined areas.

A collet 128 and drawbar adapter 130 are disposed in the sleeve 108. Specifically, the collet 128 includes an internal threaded portion 132 which threadably engages a corresponding external threaded portion 134 on the drawbar adapter 130. The collet 128 and drawbar adapter 130 are moveable relative to the sleeve 108, as will be described more fully hereinbelow.

Figure 17:
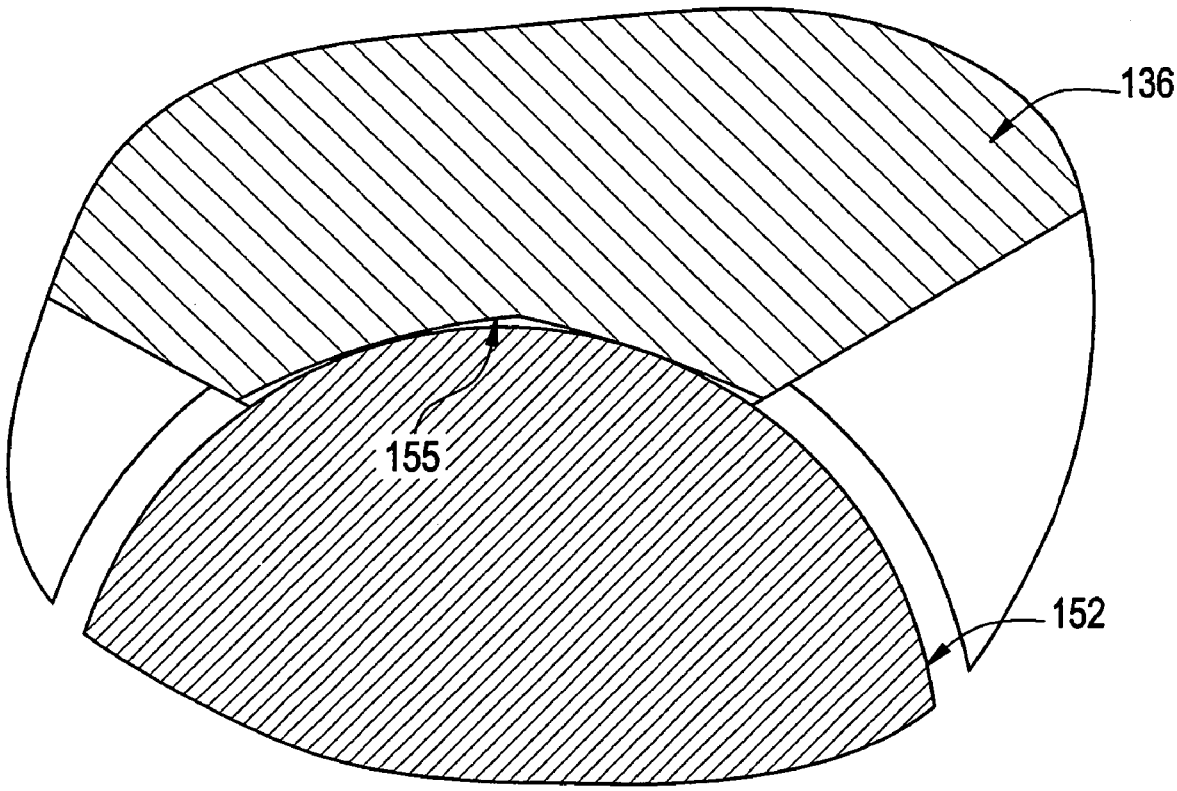
FIG. 17 is a cross-sectional view which shows one of the jaws contacting a mandrel.

A set of jaws 136 (preferably a set of three jaws) is disposed in the collet 128, proximate a front end 128 of the pulling head 100, and proximate an internal taper 140 provided in the collet 128. Each jaw 136 of the set includes an angled or conical portion 142 on an outer surface 144 and a serrated portion 146 on an inner surface 148, where the serrated portion 146 is configured to grippingly engage corresponding serrations 150 provided on the mandrel 152 of a fastener or blind bolt 154. Preferably, each of the three jaws 136 has a "V" groove configuration 155 as shown in FIG. 17, allowing the jaws 136 to grip fastener mandrels of different diameters. When the jaws 136 are in the forward-most position as illustrated in FIG. 11, the internal diameter 156 defined by the jaws 136 is generally smaller than the diameter 158 of the mandrel 152 of the fastener 154 to be inserted in the jaws 136. Hence, the jaws 136 are said to be "closed."

A jaw follower 162 is also disposed in the collet 128 and contactably engages the jaws 136, thereby effectively holding the jaws 136 in place. An end 164 of the jaw follower 162 extends into a bore 166 provided in the drawbar adapter 130. The jaw follower 162 is generally cylindrical and includes a longitudinal throughbore 168 which is configured to receive a broken stem or mandrel 152 of the blind bolt or fastener 154. The jaw follower 162 is subject to a spring load viz-a-viz spring 170.

A spring retainer 172 is disposed in the collet 128, and engages springs 170 and 174. Specifically, a first spring 174 is disposed between the drawbar adapter 130 and the spring retainer 172, and a second spring 170 is disposed between the spring retainer 172 and a shoulder 176 provided on the jaw follower 162. The first spring 174 has a higher rating than does the second spring 170. While the first spring 174 is configured to accommodate inertia loading during fastener installation, the second spring 170 is configured to urge the jaws 136 closed yet be relatively easily overcome by insertion of mandrels of different diameters in the opening 120 in the end 122 of the pulling head 100.

The jaw follower 162 is loaded against the back of the jaws 136 by the follower spring 170 which sits in the spring retainer 172. The spring retainer 172 is pushed against a shoulder 178 in the collet 128 by the heavy spring 174 which acts on the back face 179 of the spring retainer 172. The opposite end 180 of the heavy spring 174 contacts the front face 182 of the drawbar adapter 130. Both springs 170 and 174 are compressed in the pulling head's "home" position to provide a pre-load on the internal components. These internal components comprise a subassembly that moves with the head piston of the installation tool during the fastener installation cycle.

The pulling head as shown in FIG. 11 is shown in its "home" position, i.e., positioned before the installation tool to which it is attached, is activated. The follower spring 170 maintains a pre-load on the jaw follower 162, which keeps the jaws 136 positioned. The heavy spring 174 maintains a pre-load on the spring retainer 172; however, because the spring retainer 172 bottoms against a shoulder 178, the load from the heavy spring 174 is not transmitted to the jaw follower 162. This feature allows a separation of the function of the two springs: the follower spring 170 has a relatively low spring rate and will hold the jaws 136 in position without causing the operator to exert excessive force to insert the fastener 154 into the opening 120 in the end 122 of the pulling head 120.

Figure 12:
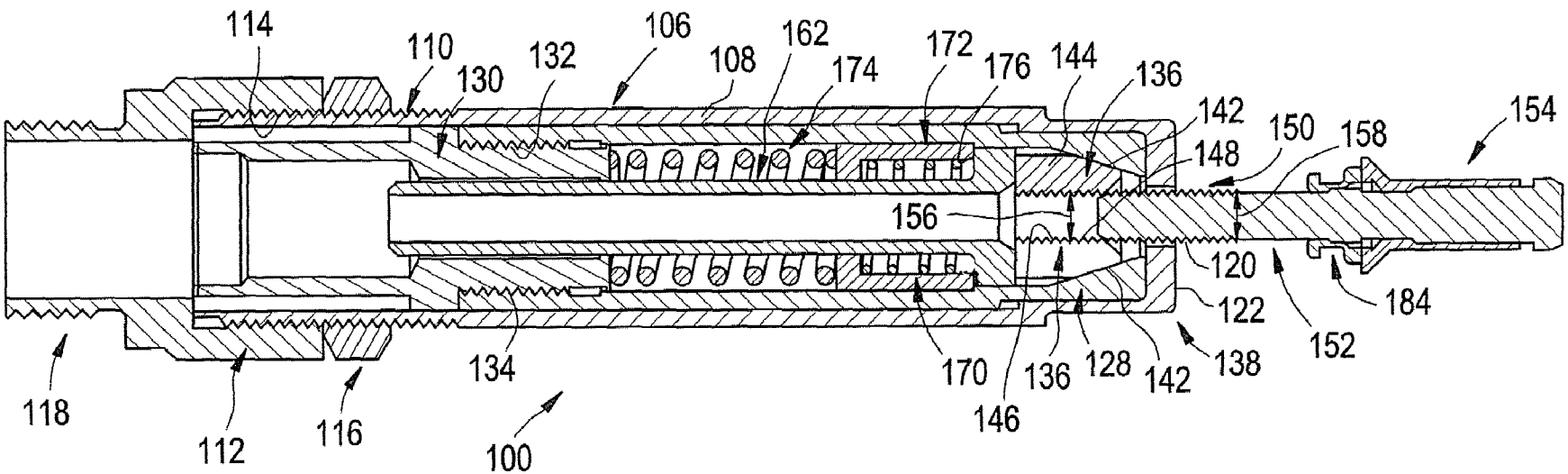
FIGS. 12-16 are views similar to FIG. 6, showing a sequence of operation of the pulling head.

The fastener 154 is placed into the pulling head 100 by inserting the mandrel 152 of the fastener 154 into the opening 120 in the sleeve 108. The jaws 136 sit in the taper 140 of the collet 128 under a spring load. The inner shape formed by the jaws 136 at this position is not large enough to allow the mandrel 152 to enter. FIG. 12 shows the mandrel 152 after it has pushed the jaws 136 back to the point where the jaws 136 have opened almost enough to receive the mandrel 152.

Figure 13:
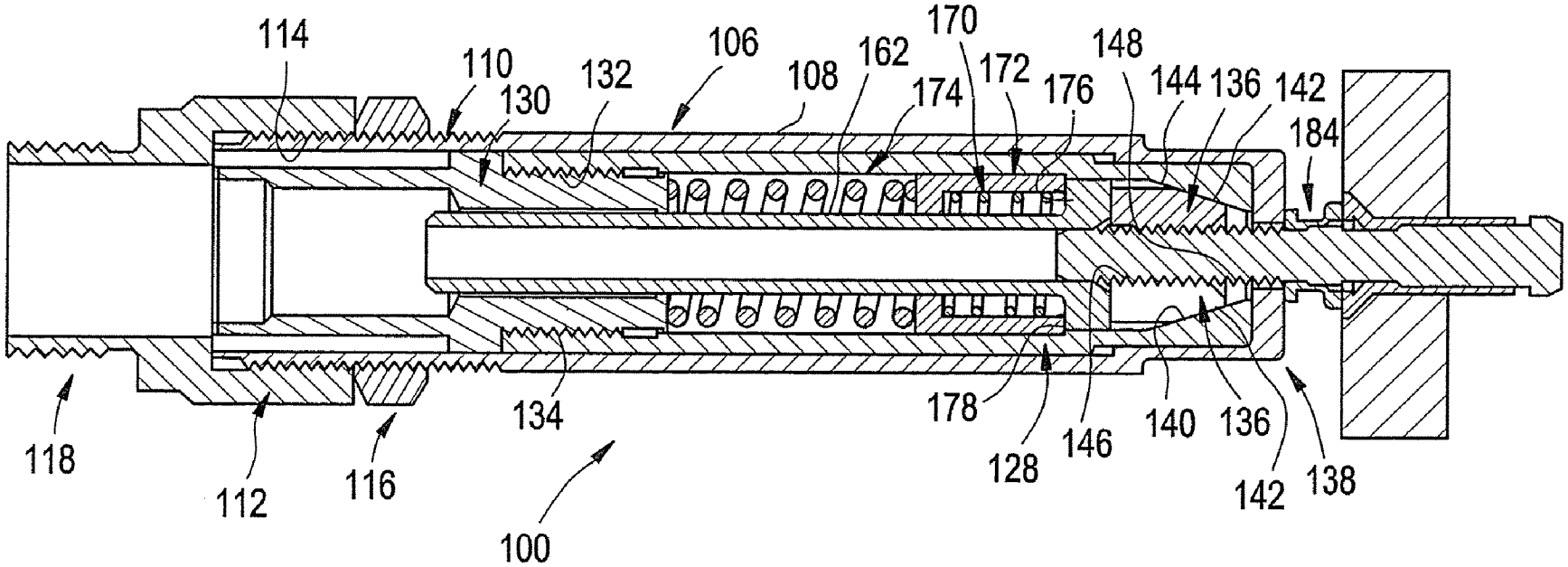

The mandrel 152 opens the jaws 136 against the spring load provided by spring 170, as the fastener 154 is inserted until the shift washer 184 of the fastener 154 bottoms on the sleeve 108, as shown in FIG. 13. The jaws 136 move back in the sleeve 108 as they expand, and their serrations 146 become aligned with the serrations 150 of the mandrel 152. The follower spring 170 compresses, and the jaws 136 push back the jaw follower 162, but the jaw follower 162 does not touch the spring retainer 172. The heavy spring 174 does not compress any from its pre-loaded length.

Figure 14:
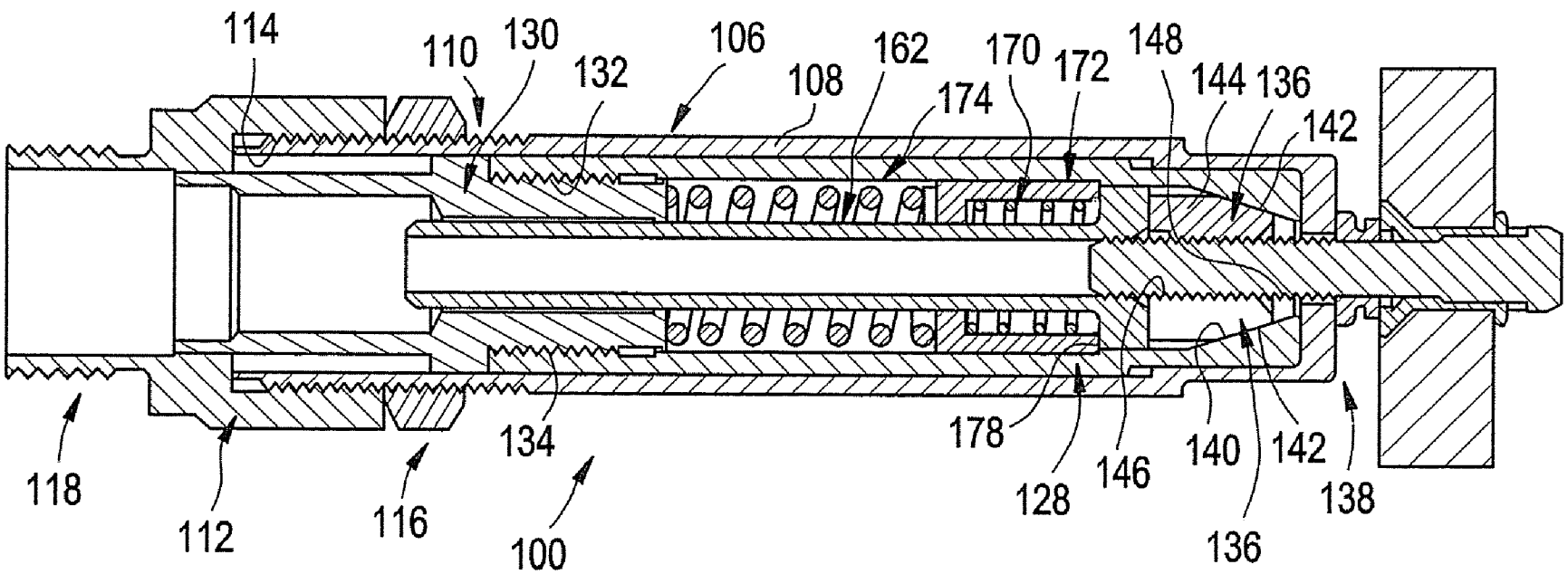

When the trigger of the tool is depressed, the internal subassembly (i.e., collet 128, drawbar adapter 130, etc.), which is attached to the head piston of the tool, moves back under load. FIG. 14 shows the pulling head 100 in mid-stroke, just before the mandrel 152 breaks. The travel of the head piston and collet/drawbar adapter is known as the stroke of the tool, which may be 9/16", for example. The fastener 154 is installed as the mandrel 152 breaks at the break notch. The remaining portion of the mandrel 152 is still held by the jaws 136.

Figure 15:
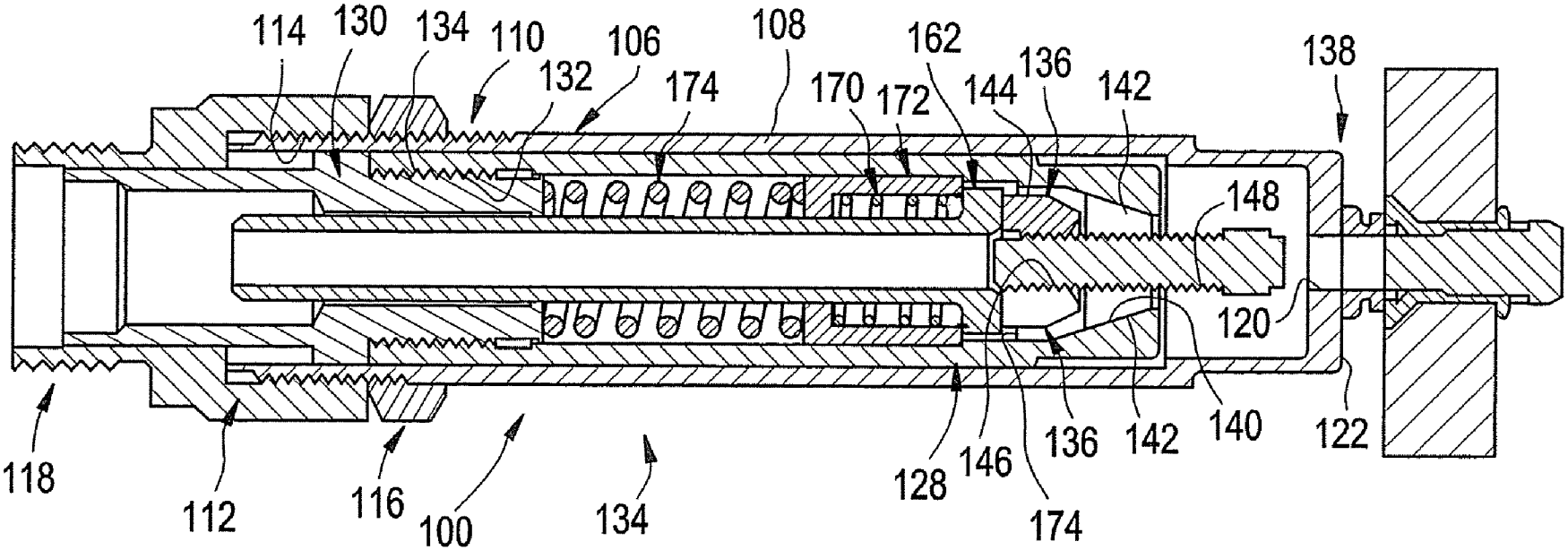

When the mandrel 152 breaks, the released energy causes the jaws 136 and jaw follower 162 to move back, contacting the spring retainer 172. Because of the cup shape of the spring retainer 172, the follower spring 170 can only be compressed to a pre-determined safe length, and will not take a "set" or fail. FIG. 15 shows the jaws 136, having broken contact with the taper 140 of the collet 128, moving with the jaw follower 162 and spring retainer 172 as one unit. This movement is resisted by the heavy spring 174, which acts as a shock absorber.

Figure 16:
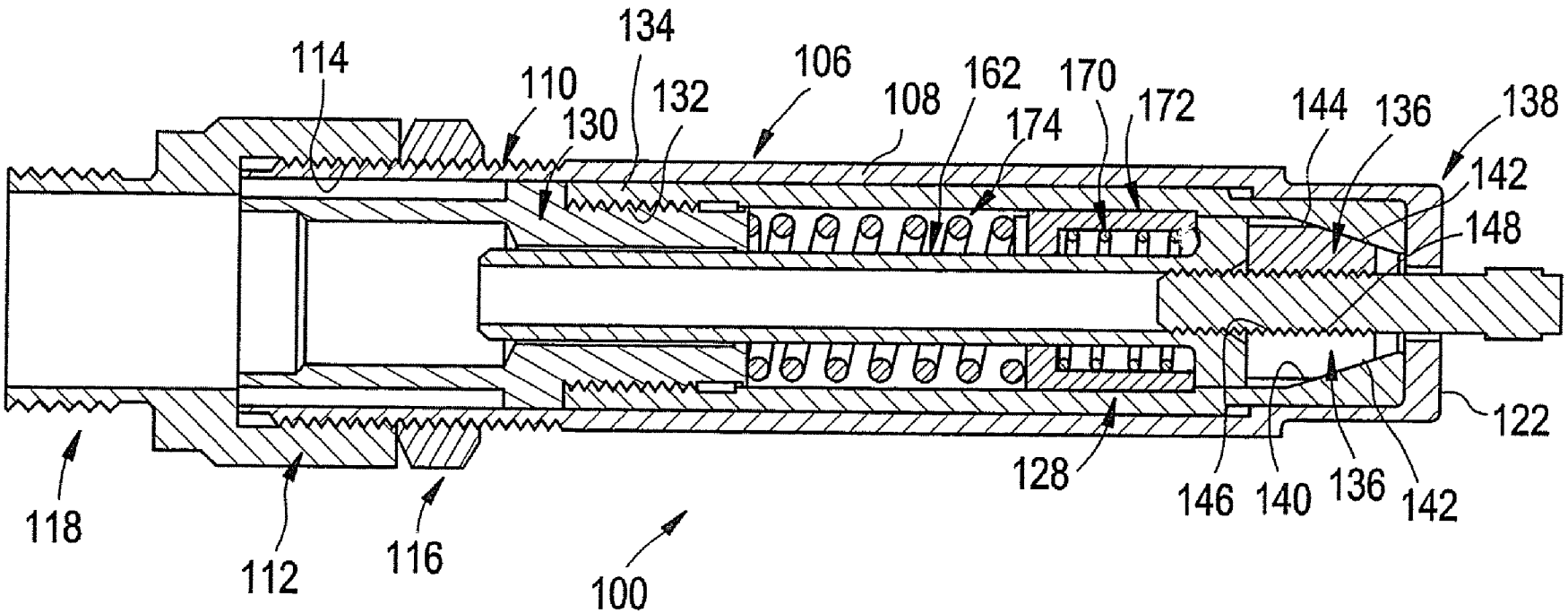

When the tool's trigger is released, the head piston and internal subassembly return to their home position. The broken mandrel 152 is still held in the jaws 136 under a spring load (provided by spring 170). The mandrel 152 often protrudes from the sleeve 108 as shown in FIG. 16. When the next fastener is inserted, its mandrel must push the broken mandrel of the previous fastener through the jaws 136. That mandrel is pushed into a tube portion 188 of the jaw follower 162, and eventually will be pushed through the head piston and out the back of the installation tool.

Figure 18:
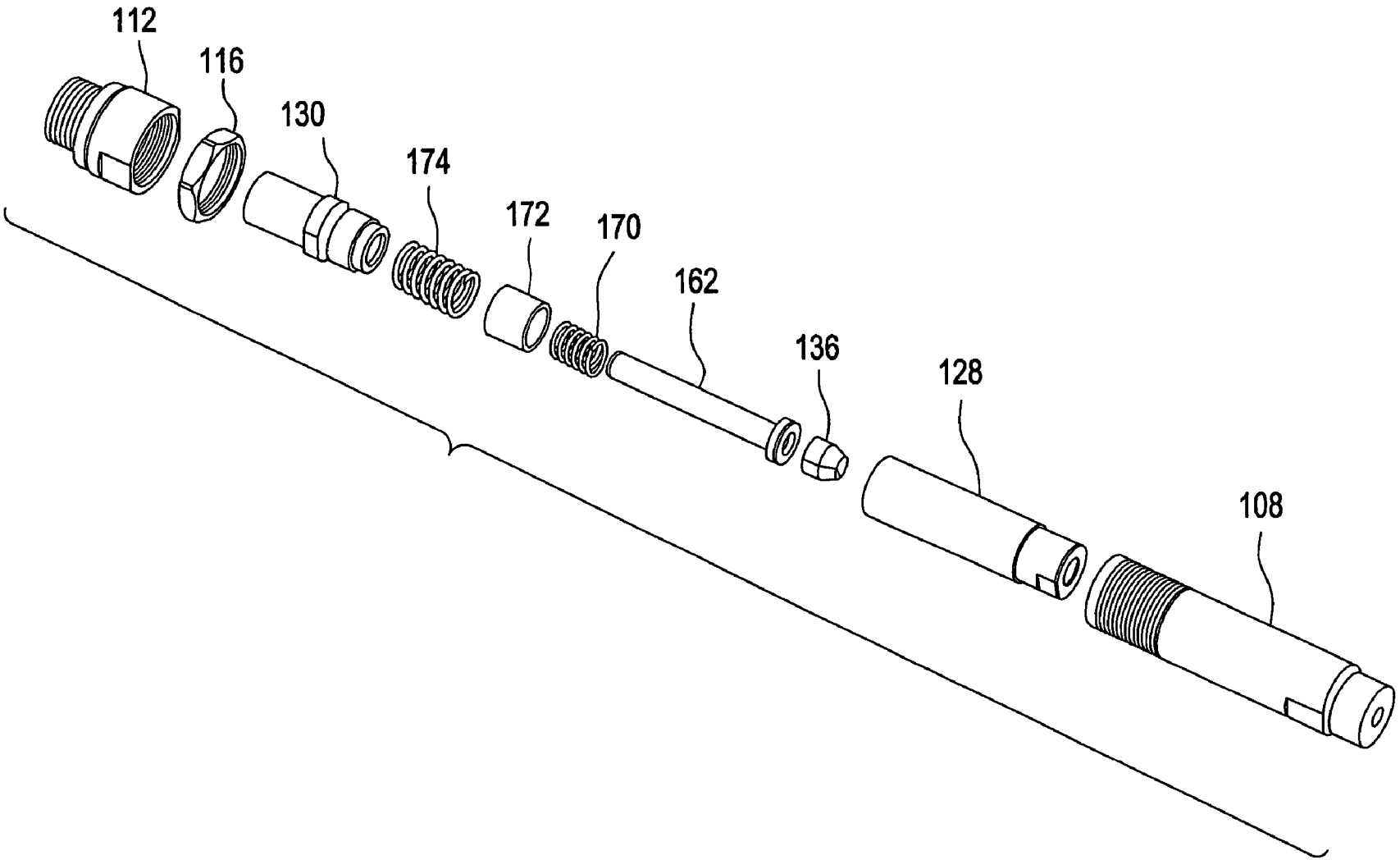
FIG. 18 is an exploded perspective view of the pulling head shown in FIGS. 11-16.

FIG. 18 is an exploded perspective view of the pulling head shown in FIGS. 11-16. The fact that the pulling head 100 includes two springs 170, 174 having different spring rates provides that the pulling head 100 can be used in association with a wide range of mandrel diameters, as well as provides that the pulling head 100 can accommodate high inertia loading. Furthermore, preferably the pulling head 100 does not include a nosepiece and is configured such that fasteners with very short stems can be installed using the pulling head 100.

While an embodiment of the present invention is shown and described, it is envisioned that those skilled in the art may devise various modifications of the present invention without departing from the spirit and scope of the disclosure.

What is claimed is:

1. A pulling head engageable with an installation tool and configured to pull on a mandrel, said pulling head comprising a body which is engageable with the installation tool, wherein the body comprises a sleeve, a first spring which is disposed in the body, a second spring which is disposed in the body, a collet, and a drawbar adapter, wherein said collet is threadably engaged with the drawbar adapter, and the collet and drawbar adapter are disposed and slidable in the sleeve, wherein said first spring is configured to provide that the pulling head accommodates inertia loading, and said second spring is configured to provide that the pulling head is useable in association with a range of mandrel diameters, wherein the first spring is rated higher than the second spring, further comprising a spring retainer which is desposed in the collet, and engages the first spring and second spring, and a jaw follower which is disposed in the collet and which contactably engages the jaws, wherein the first spring is disposed between the drawbar adapter and the spring retainer, and the second spring is disposed between the spring retainer and the jaw follower, wherein said spring retainer bottoms against a shoulder of the collet such that the load from the first spring is not transmitted to the jaw follower, wherein a spring force of said first spring need not be overcome to install a mandrel in the pulling head.

2. A pulling head as recited in claim 1, wherein the body includes a first end configured to engage the installation tool and a second, opposite end having an opening for receiving the mandrel, wherein said second spring is closer to said opening than is said first spring, and said first spring is closer to said first end of said second spring.

3. A pulling head as recited in claim 1, further comprising a sleeve adapter and a jam nut, wherein the sleeve threadable engages the sleeve adapter, and the jam nut secures the sleeve relative to the sleeve adapter.

4. A pulling head as recited in claim 1, further comprising a set of jaws disposed in the collet, proximate a taper provided in the collet.

5. A pulling head as recited in claim 4, wherein each of the jaws has a V-shaped surface for contacting the mandrel.

6. A pulling head as recited in claim 1, further comprising a set of jaws disposed in the collet, wherein said collet includes an internal taper, and wherein said jaws are spring biased toward said internal taper by said second spring.

7. A pulling head as recited in claim 1, further comprising by further characterized by a set of jaws disposed in the collet, and a jaw follower which is disposed in the collet and which contactably engages the jaws.

* * * * *